US010161404B2

(12) United States Patent
Tsutsui et al.

(10) Patent No.: US 10,161,404 B2
(45) Date of Patent: Dec. 25, 2018

(54) TURBO-MOLECULAR PUMP

(71) Applicant: SHIMADZU CORPORATION, Kyoto (JP)

(72) Inventors: Shingo Tsutsui, Kyoto (JP); Tetsuya Tsubokawa, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 245 days.

(21) Appl. No.: 14/720,092

(22) Filed: May 22, 2015

(65) Prior Publication Data

US 2015/0354577 A1 Dec. 10, 2015

(30) Foreign Application Priority Data

Jun. 4, 2014 (JP) ..... 2014-115806

(51) Int. Cl.

| | |
|---|---|
| ***F04D 19/04*** | (2006.01) |
| ***F04D 29/58*** | (2006.01) |
| ***F04D 29/54*** | (2006.01) |
| ***F04D 29/32*** | (2006.01) |
| ***F04D 29/02*** | (2006.01) |

(52) U.S. Cl.

CPC ..... *F04D 19/042* (2013.01); *F04D 29/023* (2013.01); *F04D 29/32* (2013.01); *F04D 29/542* (2013.01); *F04D 29/5853* (2013.01); *F05D 2230/90* (2013.01); *F05D 2260/607* (2013.01); *F05D 2260/95* (2013.01);

(Continued)

(58) Field of Classification Search

CPC ..... F04D 19/04; F04D 19/042; F04D 19/044; F04D 29/5853; F04D 29/324

See application file for complete search history.

(56) References Cited

U.S. PATENT DOCUMENTS 5,924,841 A 7/1999 Okamura et al.
6,793,466 B2 * 9/2004 Miyamoto ..... F04D 19/04 415/177

(Continued)

FOREIGN PATENT DOCUMENTS

JP 612794 2/1994
JP 2000-161286 6/2000

(Continued)

OTHER PUBLICATIONS

English translation of Chinese Office Action dated Apr. 19, 2017 for corresponding Chinese Application No. 201510209327.4.

(Continued)

*Primary Examiner* — Jason D Shanske
*Assistant Examiner* — John S Hunter, Jr.
(74) *Attorney, Agent, or Firm* — Renner Otto Boisselle & Sklar, LLP

(57) ABSTRACT

A turbo-molecular pump comprises: a pump rotor including rotor blades and a rotor cylindrical section; stationary blades facing the rotor blades; a cylindrical stator facing the rotor cylindrical section; a base housing the cylindrical stator; and a heating member for heating the cylindrical stator. An emissivity of an outer surface of the cylindrical stator and an emissivity of an outer surface of a member facing the cylindrical stator, the outer surface facing the cylindrical stator, are lower than the emissivity of outer surfaces of the rotor blades, the outer surfaces facing the stationary blades.

8 Claims, 6 Drawing Sheets

(52) U.S. Cl.
CPC .... *F05D 2300/16* (2013.01); *F05D 2300/173* (2013.01); *F05D 2300/611* (2013.01)

(56) References Cited

U.S. PATENT DOCUMENTS

| | | | | |
|---|---|---|---|---|
| 2002/0039533 | A1 | 4/2002 | Miyamoto | |
| 2012/0207592 | A1* | 8/2012 | Tsutsui | F04D 29/388 415/200 |
| 2015/0226229 | A1 | 8/2015 | Tsutsui | |

FOREIGN PATENT DOCUMENTS

| | | |
|---|---|---|
| JP | 3160504 | 4/2001 |
| JP | 2002180988 | 6/2002 |
| JP | 2004-176585 | 6/2004 |
| JP | 2006-37951 | 2/2006 |
| JP | 2007-262581 | 10/2007 |
| JP | 2010112202 A | 5/2010 |
| WO | 2011024261 | 3/2011 |
| WO | WO 2014/045438 | 3/2014 |

OTHER PUBLICATIONS

Notification of Reasons for Refusal dated Dec. 25, 2017 for corresponding Japanese Patent Application No. 2014-115806 (English language translation).

* cited by examiner

FIG. 2A

| | Present embodiment | | | |
|---|---|---|---|---|
| | Base material | Outer surface to be subject | Surface treatment on outer surface on left column | Emissivity |
| Cylindrical stator | Aluminum alloy | Entire outer surface | No surface treatment | $\varepsilon \leqq 0.1$ |
| Rotor cylindrical section | Aluminum alloy | Outer surface facing cylindrical stator | Ni plating | $\varepsilon = 0.2$ |
| Rotor blades | Aluminum alloy | Outer surfaces facing stationary blades | Black Ni plating | $\varepsilon = 0.7$ |
| | | Outer surface facing cylindrical stator | No surface treatment | $\varepsilon \leqq 0.1$ |
| Stationary blades | Aluminum alloy | Outer surfaces facing rotor blades | Anodizing | $\varepsilon = 0.9$ |
| | | Outer surface facing cylindrical stator | No surface treatment | $\varepsilon \leqq 0.1$ |
| Base | Aluminum alloy | Outer surface facing cylindrical stator | No surface treatment | $\varepsilon \leqq 0.1$ |

FIG. 2B

| | Comparative Example 1,2 | | | |
|---|---|---|---|---|
| | Base material | Outer surface to be subject | Surface treatment on outer surface on left column | Emissivity |
| Cylindrical stator | Aluminum alloy | Entire outer surface | Black Ni plating | $\varepsilon = 0.7$ |
| Rotor cylindrical section | Aluminum alloy | Outer surface facing cylindrical stator | Black Ni plating | $\varepsilon = 0.7$ |
| Rotor blades | Aluminum alloy | Outer surfaces facing stationary blades | Black Ni plating | $\varepsilon = 0.7$ |
| | | Outer surface facing cylindrical stator | Black Ni plating | $\varepsilon = 0.7$ |
| Stationary blades | Aluminum alloy | Outer surfaces facing rotor blades | Black Ni plating | $\varepsilon = 0.7$ |
| | | Outer surface facing cylindrical stator | Black Ni plating | $\varepsilon = 0.7$ |
| Base | Aluminum alloy | Outer surface facing cylindrical stator | Black Ni plating | $\varepsilon = 0.7$ |

High emissivity region
Low emissivity region

Comparative Example 1

Comparative Example 2

Present embodiment
1A
1b
1
10
12
S1
S2
H1
21
H2
S5
H3
H4
S4
22
13
28
S3
H13
23
S6
H5
H6
H10
50
H11
27
24
H12
20
H7
S7
H9
H8
21S
12S
S3C
S3B
S3D
S3A

TURBO-MOLECULAR PUMP

BACKGROUND OF THE INVENTION

1. Field of the Invention

The present invention relates to a turbo-molecular pump.

2. Description of the Related Art

Conventionally, there has been used a vacuum pump such as a turbo-molecular pump for chamber evacuation in a semiconductor manufacturing apparatus or a liquid crystal manufacturing apparatus, or the like.

A pump rotor of such a turbo-molecular pump is supported in a contactless manner by magnetic bearings and rotates at high speed. The pump rotor collides with process gas or the like and thereby has a high temperature. In view of this, in order to prevent breakage caused by creep deformation, the emissivity of the outer surface of the pump rotor or the emissivity of the outer surfaces of stationary blades and a cylindrical stator arranged around the pump rotor may be increased to increase the amount of heat release by radiation of the pump rotor.

In recent years, in an etching process performed by a semiconductor manufacturing apparatus or a liquid crystal manufacturing apparatus, the amount of reaction products adhered to a cylindrical stator of a vacuum pump increases, which may cause contact between a pump rotor of the vacuum pump and the reaction products. Further, an overhaul is required within a short period of time after starting the operation of the apparatus. Thus, there has been a need to make the temperature inside the pump (the temperature of a gas contact part) considerably higher than a conventional temperature to suppress adhesion of reaction products.

A method as disclosed in JP 3160504 B1 is known as a method of increasing the temperature inside a pump. In the invention disclosed in JP 3160504 B1, a heating target member (corresponding to a cylindrical stator of a screw groove pump member) which is arranged to face the outer periphery of a rotor cylindrical section of a pump rotor is directly heated.

In the invention as disclosed in JP 3160504 B1, the emissivity of the outer surface of the cylindrical stator and the emissivity of the outer surfaces of members around the cylindrical stator may be increased. In this case, when the temperature of the cylindrical stator is higher than the temperature of the members around the cylindrical stator, heat transfer by radiation from the cylindrical stator to the members around the cylindrical stator unnecessarily occurs. As a result, the temperature of the pump rotor may increase.

Therefore, there is desired a turbo-molecular pump that prevents accumulation of reaction products on a cylindrical stator and suppresses heat transfer by radiation from the cylindrical stator to members around the cylindrical stator.

SUMMARY OF THE INVENTION

A turbo-molecular pump comprises: a pump rotor including rotor blades and a rotor cylindrical section; stationary blades facing the rotor blades; a cylindrical stator facing the rotor cylindrical section; abase housing the cylindrical stator; and a heating member for heating the cylindrical stator. An emissivity of an outer surface of the cylindrical stator and an emissivity of an outer surface of a member facing the cylindrical stator, the outer surface facing the cylindrical stator, are lower than the emissivity of outer surfaces of the rotor blades, the outer surfaces facing the stationary blades.

The member facing the cylindrical stator is at least one of the following members: the rotor cylindrical section, the base, the rotor blades, and the stationary blades.

A temperature of the cylindrical stator becomes higher than a temperature of the pump rotor by heating the cylindrical stator by the heating member.

The emissivity of the outer surface of the cylindrical stator and the emissivity of the outer surface of the member facing the cylindrical stator, the outer surface facing the cylindrical stator, are 0.3 or less.

The emissivity of the outer surfaces of the rotor blades, the outer surfaces facing the stationary blades, and emissivity of outer surfaces of the stationary blades, the outer surfaces facing the rotor blades, are 0.5 or more.

The outer surface of the cylindrical stator and the outer surface of the member facing the cylindrical stator, the outer surface facing the cylindrical stator, are Ni plated or aluminum alloys without surface treatment.

The outer surfaces of the rotor blades, the outer surfaces facing the stationary blades, and outer surfaces of the stationary blades, the outer surfaces facing the rotor blades, are black Ni plated or anodized.

The turbo-molecular pump further comprises a heat conduction suppressing member, and the cylindrical stator is attached to the base with the heat conduction suppressing member interposed therebetween.

The present invention makes it possible to prevent accumulation of reaction products on the cylindrical stator and suppress heat transfer by radiation from the cylindrical stator to the members around the cylindrical stator.

BRIEF DESCRIPTION OF THE DRAWINGS

FIGS. 2A and 2B are tables showing base materials, surface treatments, and the emissivity of outer surfaces in the embodiment of the present invention and Comparative Examples 1 and 2;

DETAILED DESCRIPTION OF PREFERRED EMBODIMENT

Figure 1:
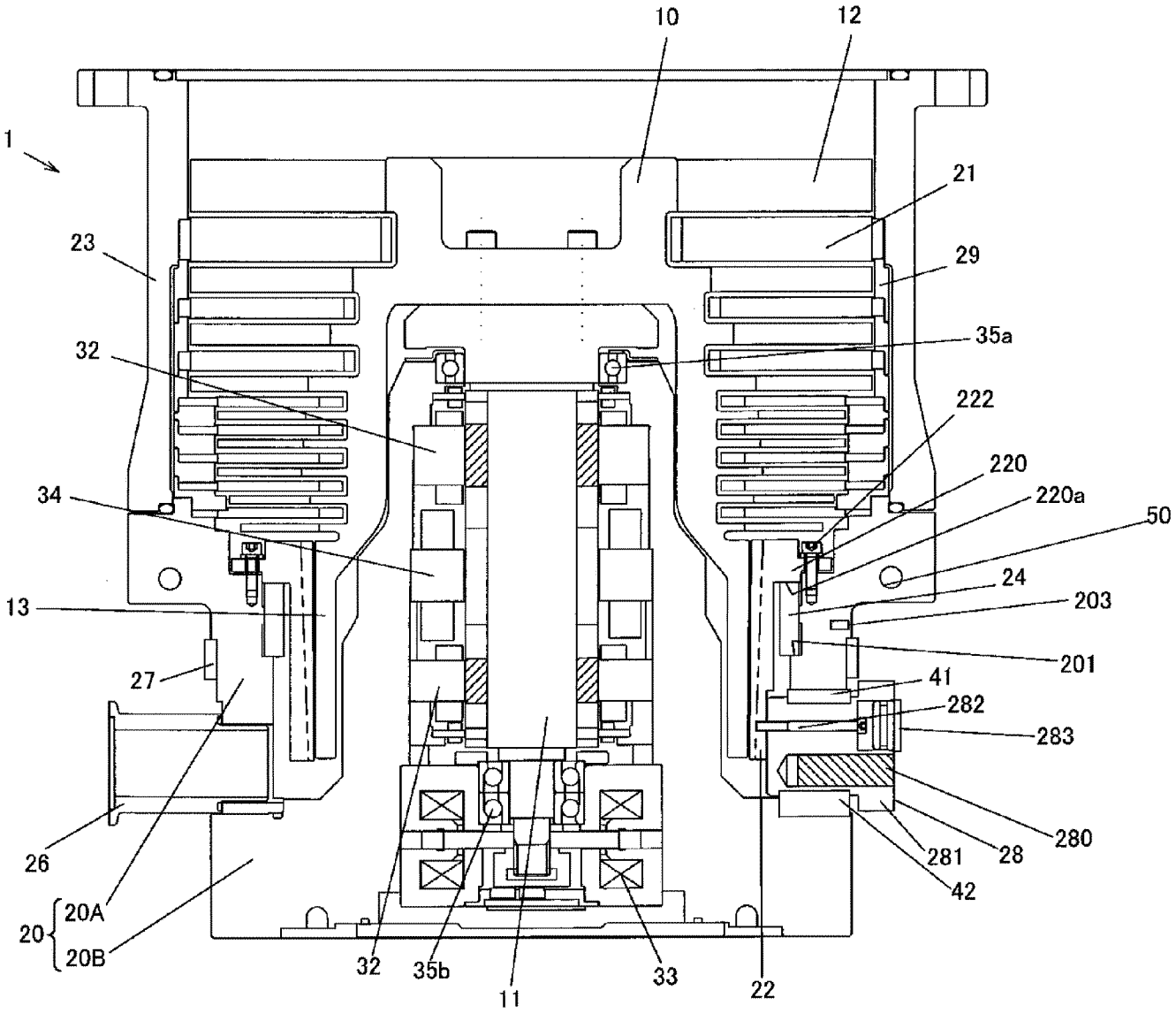
FIG. 1 is a cross-sectional view of a turbo-molecular pump of an embodiment of the present invention.

Hereinafter, an embodiment of the present invention will be described with reference to the drawings. FIG. 1 is a cross-sectional view of a turbo-molecular pump 1 according to the present invention. The turbo-molecular pump 1 is provided with a pump rotor 10 which includes a plurality of stages of rotor blades 12 and a rotor cylindrical section 13 formed thereon. A plurality of stages of stationary blades 21 are arranged to be stacked corresponding to the plurality of stages of rotor blades 12 inside a pump casing 23. The plurality of stages of stationary blades 21 stacked in the pump axial direction are arranged on a base 20 with spacers 29 interposed therebetween. The rotor blades 12 include a plurality of turbine blades arranged in the circumferential direction, and the stationary blades 21 include a plurality of turbine blades arranged in the circumferential direction. The base 20 is divided into two sections referred to as a base upper section 20A located on the upper side in the drawing and a base lower section 20B located on the lower side in the drawings.

A cylindrical stator 22 is arranged on the outer peripheral side of the rotor cylindrical section 13 with a gap interposed therebetween. A screw groove is formed on either the outer peripheral surface of the rotor cylindrical section 13 or the inner peripheral surface of the stator 22. The rotor cylindrical section 13 and the cylindrical stator 22 together constitute a screw groove pump member. Gas molecules discharged by the rotor blades 12 and the stationary blades 21 are further compressed by the screw groove pump member and eventually discharged through an exhaust port 26 disposed on the base 20.

A rotor shaft 11 is fixed to the pump rotor 10. The rotor shaft 11 is supported by a radial magnetic bearing 32 and an axial magnetic bearing 33 and driven to rotate by a motor 34. The rotor shaft 11 is supported by mechanical bearings 35*a*, 35*b* when the magnetic bearings 32, 33 are not operating. The radial magnetic bearing 32, the axial magnetic bearing 33, the motor 34, and the mechanical bearing 35*b* are housed in the base lower section 20B which is fixed to the base 20.

The base 20 is provided with a heater 27 for heating the base 20, a water-cooled pipe 50 for cooling the base 20, and a temperature sensor 203 which detects the temperature of the base 20.

The cylindrical start 22 is attached to the base upper section 20A using bolts 222 with a cylindrical heat conduction suppressing member 24 interposed therebetween and housed inside the base 20. Specifically, the heat conduction suppressing member 24 is held between a lower surface 220*a* of a flange section 220 of the cylindrical stator 22 and a recess 201 formed on the base upper section 20A. In this state, the cylindrical stator 22 is fixed to the base upper section 20A with the bolts 222 through the flange section 220. A space is provided between the cylindrical stator 22 and the base upper section 20A so as to prevent direct contact between the cylindrical stator 22 and the base upper section 20A in order to prevent heat transfer by conduction between the cylindrical stator 22 and the base upper section 20A. Further, each of the bolts 222 is made of a material having a low thermal conductivity.

A stator heating member 28 dedicated for heating the cylindrical stator 22 is fixed to the outer peripheral surface of the lower part of the cylindrical stator 22. The stator heating member 28 penetrates the peripheral face of the base 20 from the inside through the outside thereof. The stator heating member 28 includes a block 281 (a heater block 281) having a high thermal conductivity as a main body. The stator heating member 28 is fixed to the cylindrical stator 22 with a bolt 282 as described above by inserting the bolt 282 into a through hole formed on the block 281. This fixing enables easy heat transfer by conduction between the block 281 of the stator heating member 28 and the cylindrical stator 22. A heater 280 is disposed inside the block 281. The heater 280 generates heat by power supplied from an external power source (not illustrated). Accordingly, the stator heating member 28 serves as a heat source. Heat generated in the stator heating member 28 is transferred to the cylindrical stator 22 by conduction. This heat transfer increases the temperature of the cylindrical stator 22, thereby suppressing accumulation of reaction products.

As described above, the stator heating member 28 is dedicated for heating the cylindrical stator 22. Thus, a configuration for preventing heat generated in the stator heating member 28 from being transferred to the base 20 by conduction is provided. Specifically, a heat insulation member 41 is provided between the stator heating member 28 and the base upper section 20A, and a heat insulation member 42 is provided between the stator heating member 28 and the base lower section 20B.

In this manner, heat transfer by conduction does not occur in the cylindrical stator 22 excepting that the cylindrical stator 22 is heated by the stator heating member 28 and cooled to some extent by the heat conduction suppressing member 24.

FIGS. 2A and 2B are tables showing base materials, outer surfaces to be the subject for describing the present invention, surface treatments on the outer surfaces, and the emissivity in the cylindrical stator 22, the rotor cylindrical section 13, the rotor blades 12, the stationary blades 21, and the base 20. FIG. 2A is a table for the embodiment of the present invention. FIG. 2B is a table for Comparative Examples 1 and 2 (described below). The base materials of the cylindrical stator, the rotor cylindrical section, the rotor blades, the stationary blades, and the base are aluminum alloys in any of the present embodiment and Comparative Examples 1 and 2.

Figures 3A, 3B, 3C:
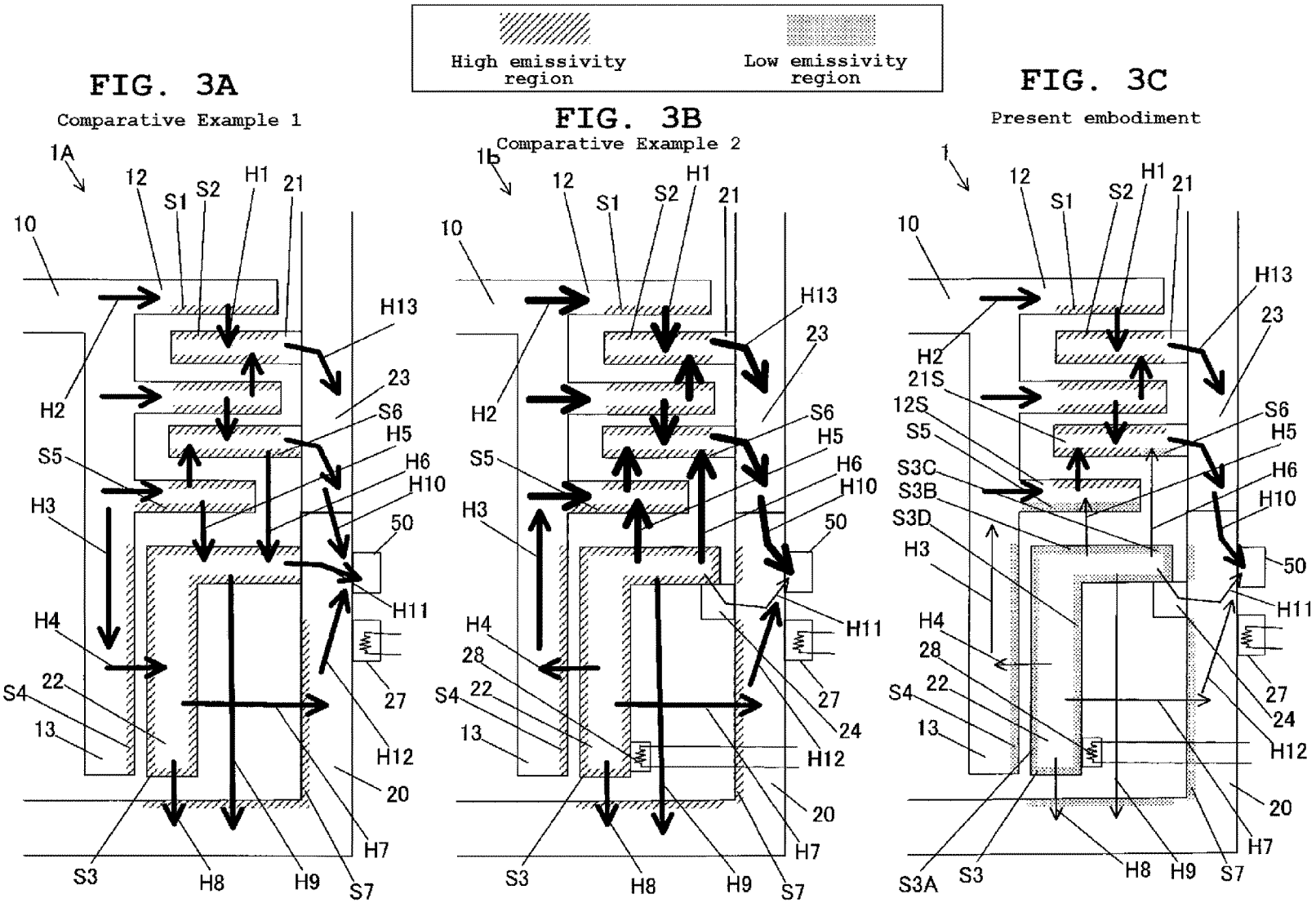
FIGS. 3A to 3C are schematic views showing heat transfer by radiation or conduction of turbo-molecular pumps in the embodiment of the present invention and Comparative Examples 1 and 2.

FIG. 3C is a schematic view showing a right part (in the drawing) of the turbo-molecular pump 1 shown in FIG. 1, specifically, showing heat transfer in the present embodiment. FIGS. 3A and 3B respectively show heat transfer in Comparative Examples 1 and 2 (described below).

The state of the outer surfaces and heat transfer in the present embodiment will be described with reference to FIGS. 2A and 3C.

In FIG. 2A, each emissivity is set so as to suppress heat transfer by radiation from the cylindrical stator 22 to peripheral members of the cylindrical stator 22, specifically, the rotor cylindrical section 13, the rotor blades 12, the stationary blades 21, and the base 20 when the temperature of the cylindrical stator 22 becomes higher than the temperature of the peripheral members. The case in which the temperature of the cylindrical stator 22 becomes higher than the temperature of the peripheral members can be achieved by thermally isolating the cylindrical stator 22 by the heat conduction suppressing member 24 and heating the cylindrical stator 22 in the isolated state by the stator heating member 28. Further, "thermally isolating" means suppressing heat conduction as indicated by H11 of FIG. 3C by the heat conduction suppressing member 24.

Here, radiation of heat will be described. Heat by radiation from an object 1 to an object 2 is represented by the following Expression (1). The temperature of the object 1 is higher than the temperature of the object 2.

[Expression 1]

$$Q \propto \varepsilon' \cdot A \cdot (T_1^4 - T_2^4) \quad (1)$$

(Stefan-Boltzmann Expression)

In Expression (1), Q denotes radiant heat (W), ε' denotes the average emissivity, A denotes the heat transfer cross-sectional area ($cm^2$), $T_1$ denotes the temperature (° K) of the object 1, and $T_2$ denotes the temperature (° K) of the object 2. Since the temperature of the object 1 is higher than the temperature of the object 2, $T_1$ has a larger value than $T_2$.

The average emissivity ε' is obtained from the emissivity $\varepsilon_1$ of the object 1, the emissivity $\varepsilon_2$ of the object 2, and the positional relationship between the object 1 and the object 2. Regardless of the positional relationship between the object 1 and the object 2, the lower the emissivity $\varepsilon_1$ is and the lower the emissivity $\varepsilon_2$ is, the lower the average emissivity ε' becomes. Thus, based on this fact and Expression (1), the lower the emissivity $\varepsilon_1$ is and the lower the emissivity $\varepsilon_2$ is, the smaller the amount of heat by radiation from the object 1 to the object 2 becomes.

As an example, when there is a parallel plane positional relationship between the object 1 and the object 2, the average emissivity ε' is represented by the following Expression (2).

[Expression 2]

$$\varepsilon' = \frac{\varepsilon_1\varepsilon_2}{\varepsilon_2 + \varepsilon_1 - \varepsilon_1\varepsilon_2} = \frac{1}{\left(\frac{1}{\varepsilon_1} + \frac{1}{\varepsilon_2} - 1\right)} \tag{2}$$

As understood from Expression (2), the lower the emissivity $\varepsilon_1$ of the object 1 is and the lower the emissivity $\varepsilon_2$ of the object 2 is, the lower the average emissivity ε' becomes.

In this specification, the emissivity ε=0.5 is defined as a boundary between a high emissivity and a low emissivity. Specifically, an emissivity ε of 0.5 or more is referred to as "high emissivity" and an emissivity ε of less than 0.5 is referred to as "low emissivity".

As shown in FIG. 2A, in the present embodiment, the cylindrical stator 22 is made of an aluminum alloy and is not surface-treated on the entire outer surface S3 (refer to FIG. 3C) thereof. That is, the outer surface of the cylindrical stator 22 is an aluminum alloy itself. This configuration enables the emissivity of the cylindrical stator 22 to be low, specifically, 0.1 or less. The outer surface S3 is the entire outer surface of the cylindrical stator 22 including an outer surface S3A which faces the rotor cylindrical section 13, an outer surface S3B which faces the rotor blade 12, an outer surface S3C which faces the stationary blade 21, and an outer surface S3D which faces the base 20.

In the present embodiment, Ni plating is applied to an outer surface S4 (refer to FIG. 3C) of the rotor cylindrical section 13, the outer surface S4 facing the cylindrical stator 22. The Ni plating enables the emissivity of the outer surface S4 to be low, specifically, 0.2. Further, the Ni plating makes it possible to prevent corrosion caused by process gas.

In this manner, as shown in FIG. 3C, the low emissivity of each of the outer surfaces S3A, S4 suppresses transfer of heat H4 by radiation from the cylindrical stator 22 to the rotor cylindrical section 13.

In the present embodiment, no surface treatment is applied to an outer surface S7 of the base 20, the outer surface S7 facing the cylindrical stator 22, and an aluminum alloy as a base material thus forms the outer surface S7. This configuration enables the emissivity of the outer surface S7 to be 0.1 or less. The low emissivity of each of the outer surfaces S3D, S7 suppresses transfer of heat H7 to H9 by radiation from the cylindrical stator 22 to the base 20.

No surface treatment is applied to an outer surface S5 (refer to FIG. 3C) of a rotor blade 12S located on the lowest end in the rotor blades 12 (the bottom rotor blade 12), the outer surface S5 facing the cylindrical stator 22, and an aluminum alloy as a base material thus forms the outer surface S5. The low emissivity of each of the outer surfaces S3B, S5 suppresses transfer of heat H5 by radiation from the cylindrical stator 22 to the rotor blades 12. The bottom rotor blade 12S has an outer surface which does not face the stationary blades 21, and this outer surface preferably has a low emissivity.

No surface treatment is applied to an outer surface S6 (refer to FIG. 3C) of a stationary blade 21S located on the lowest end in the stationary blades 21 (the bottom stationary blade 21), the outer surface S6 facing the cylindrical stator 22, and an aluminum alloy as abase material thus forms the outer surface S6. The low emissivity of each of the outer surfaces S3C, S6 suppresses transfer of heat H6 by radiation from the cylindrical stator 22 to the stationary blades 21. The rotary blades 12 do not extend up to the inner peripheral surface of the pump casing 23. Thus, the bottom stationary blade 21S has an outer surface which does not face the rotor blades 12, and this outer surface preferably has a low emissivity.

As described above, the low emissivity of the outer surface S3 of the cylindrical stator 22 and the low emissivity of each of the outer surfaces S4 to S7 of the peripheral members of the cylindrical stator 22, the outer surfaces S4 to S7 facing the cylindrical stator 22, enable heat transfer by radiation from the cylindrical stator 22 to the peripheral members to be suppressed.

Since each of the outer surfaces S3A to S3D of the cylindrical stator 22 has a low emissivity, in the present embodiment, it is necessary to transfer heat of the pump rotor 10 by radiation mainly from the rotor blades 12 toward the stationary blades 21 as indicated by arrows H1 and H2 of FIG. 3C.

Thus, in the present embodiment, black Ni plating is applied to outer surfaces S1 of the rotor blades 12, the outer surfaces S1 facing the stationary blades 21. This configuration enables the emissivity of the outer surfaces S1 to be high, specifically, 0.7. Outer surfaces S2 of the stationary blades 21, the outer surfaces S2 facing the rotor blades 12, are anodized. This configuration enables the emissivity of the outer surfaces S2 to be high, specifically, 0.9. As a result, the amount of the heat H1 by radiation from the rotor blades 12 to the stationary blades 21 increases. Further, since black Ni plating is used, corrosion of the rotor blades 12 caused by process gas can be prevented.

The heat H1 that has been transferred from the rotor blades 12 to the stationary blades 21 is conducted to the pump casing 23 as indicated by heat H13, and then conducted from the pump casing 23 to the base 20 so as to move to the water-cooled pipe 50 as indicated by heat H10.

The slight heat H11 conducted from the cylindrical stator 22 to the base 20 through the heat conduction suppressing member 24 and slight heat H7 to H9 radiated from the cylindrical stator 22 to the base 20 are also conducted inside the base 20 so as to move to the water-cooled pipe 50.

As described above, the present invention achieves the following effects.

(1) The turbo-molecular pump 1 is provided with the pump rotor 10 which includes the rotor blades 12 and the rotor cylindrical section 13, the stationary blades 21 which face the rotor blades 12, the cylindrical stator 22 which faces the rotor cylindrical section 13, the base 20 which houses the cylindrical stator 22, and the stator heating member 28 which heats the cylindrical stator 22.

The emissivity of the outer surface S3 of the cylindrical stator 22 and the emissivity of each of the outer surfaces S4, S7, S5, and S6 of the rotor cylindrical section 13, the base 20, the rotor blades 12, and the stationary blades 21 which are the peripheral members facing the cylindrical stator 22, the outer surfaces S4, S7, S5, and S6 facing the cylindrical stator 22, are smaller than the emissivity of the outer surfaces S1 of the rotor blades 12, the outer surfaces S1 facing the stationary blades 21.

(1A) The above configuration makes it possible to suppress heat radiation from the cylindrical stator 22 to the peripheral members, specifically, the rotor cylindrical section 13, the base 20, the rotor blades 12, and the stationary blades 21 and thereby maintain the cylindrical stator 22 at a high temperature. Therefore, it is possible to prevent accumulation of reaction products on the cylindrical stator 22.

(1B) The above configuration of the peripheral members, specifically, the rotor cylindrical section 13, the rotor blades 12, and the stationary blades 21 makes it possible to facilitate transfer of the heat H1 from the rotor blades 12 to the stationary blades 21 and suppress transfer of the heat H4, H5, and H6 by radiation from the cylindrical stator 22 to the peripheral members, specifically, the rotor cylindrical section 13, the rotor blades 12, and the stationary blades 21 when the temperature of the cylindrical stator 22 is higher than the temperature of the peripheral members, specifically, the rotor cylindrical section 13, the rotor blades 12, and the stationary blades 21 to thereby suppress temperature rise of the pump rotor 10. As a result, it is possible to prevent breakage of the pump rotor 10, the stationary blades 21, or the cylindrical stator 22 caused by contact between the pump rotor 10 and the stationary blades 21 or the cylindrical stator 22 resulting from creep deformation of the pump rotor 10.

(1C) The above configuration of the base 20, which is one of the peripheral members, makes it possible to suppress unnecessary heat release to the outside by the cylindrical stator 22 and thereby prevent the stator heating member 28 from consuming unnecessary power. Further, it is possible to suppress the base 20 from receiving unnecessary heat from the cylindrical stator 22. Heat radiation from the cylindrical stator 22 to the base 20 can be suppressed to thereby maintain the cylindrical stator 22 at a high temperature. Therefore, it is possible to prevent accumulation of reaction products on the cylindrical stator 22.

(2) The stator heating member 28 may cause a regulated temperature of the cylindrical stator 22 to be higher than a regulated temperature of the pump rotor 10. Even in such a case, it is possible to suppress temperature rise of the pump rotor 10 caused by the heat H4 from the cylindrical stator 22. As a result, it is possible to prevent breakage of the pump rotor 10, the stationary blades 21, or the cylindrical stator 22 caused by contact between the pump rotor 10 and the stationary blades 21 or the cylindrical stator 22 resulting from creep deformation of the pump rotor 10.

(3) When a base material is an aluminum alloy and no surface treatment is applied thereto, it is possible to allow the outer surface thereof to have a low emissivity, specifically, 0.1 or less.

(4) A Ni plated outer surface can be allowed to have a low emissivity, specifically, 0.2. The Ni plating improves resistance to corrosion caused by process gas.

(5) A black Ni plated outer surface can be allowed to have a high emissivity, specifically, 0.7. The black Ni plating improves resistance to corrosion caused by process gas.

(6) When abase material is an aluminum alloy and the outer surface thereof is anodized, it is possible to allow the outer surface to have a high emissivity, specifically, 0.9.

(7) The cylindrical stator 22 is attached to the base 20 with the heat conduction suppressing member 24 interposed therebetween. Accordingly, it is possible to thermally isolate the cylindrical stator 22 and thereby suppress a change in the temperature of the cylindrical stator 22. As a result, when the temperature of the cylindrical stator 22 becomes high by heating the cylindrical stator 22 by the stator heating member 28, the high temperature state of the cylindrical stator 22 can be easily maintained.

Here, based on comparison between the turbo-molecular pump 1 of the present embodiment and a turbo-molecular pump 1A of Comparative Example 1 and between the turbo-molecular pump 1 and a turbo-molecular pump 1B of Comparative Example 2, heat transfer resulting from differences in measures against reaction products and configuration will be described with reference to FIGS. 2A to 5.

As shown in FIG. 3A, in the turbo-molecular pump 1A of Comparative Example 1, a cylindrical stator 22 is directly connected to a base 20. That is, the turbo-molecular pump 1A is not provided with the heat conduction suppressing member 24. Further, the turbo-molecular pump 1A is not provided with the stator heating member 28 dedicated for heating the cylindrical stator 22. As shown in FIG. 2B, in the turbo-molecular pump 1A of Comparative Example 1, base materials of the cylindrical stator 22, a rotor cylindrical section 13, rotor blades 12, stationary blades 21, and the base 20 are aluminum alloys and outer surfaces to be the subjects in the present embodiment are black Ni plated.

As shown in FIG. 3B, in the turbo-molecular pump 1B of Comparative Example 2, a cylindrical stator 22 is attached to a base 20 with a heat conduction suppressing member 24 interposed therebetween as with the present embodiment. Further, as with the present embodiment, the turbo-molecular pump 1B is provided with a stator heating member 28 dedicated for heating the cylindrical stator 22. As shown in FIG. 2B, in the turbo-molecular pump 1A of Comparative Example 1, base materials of the cylindrical stator 22, a rotor cylindrical section 13, rotor blades 12, stationary blades 21, and the base 20 are aluminum alloys and outer surfaces to be the subjects in the present embodiment are black Ni plated.

Figure 4:
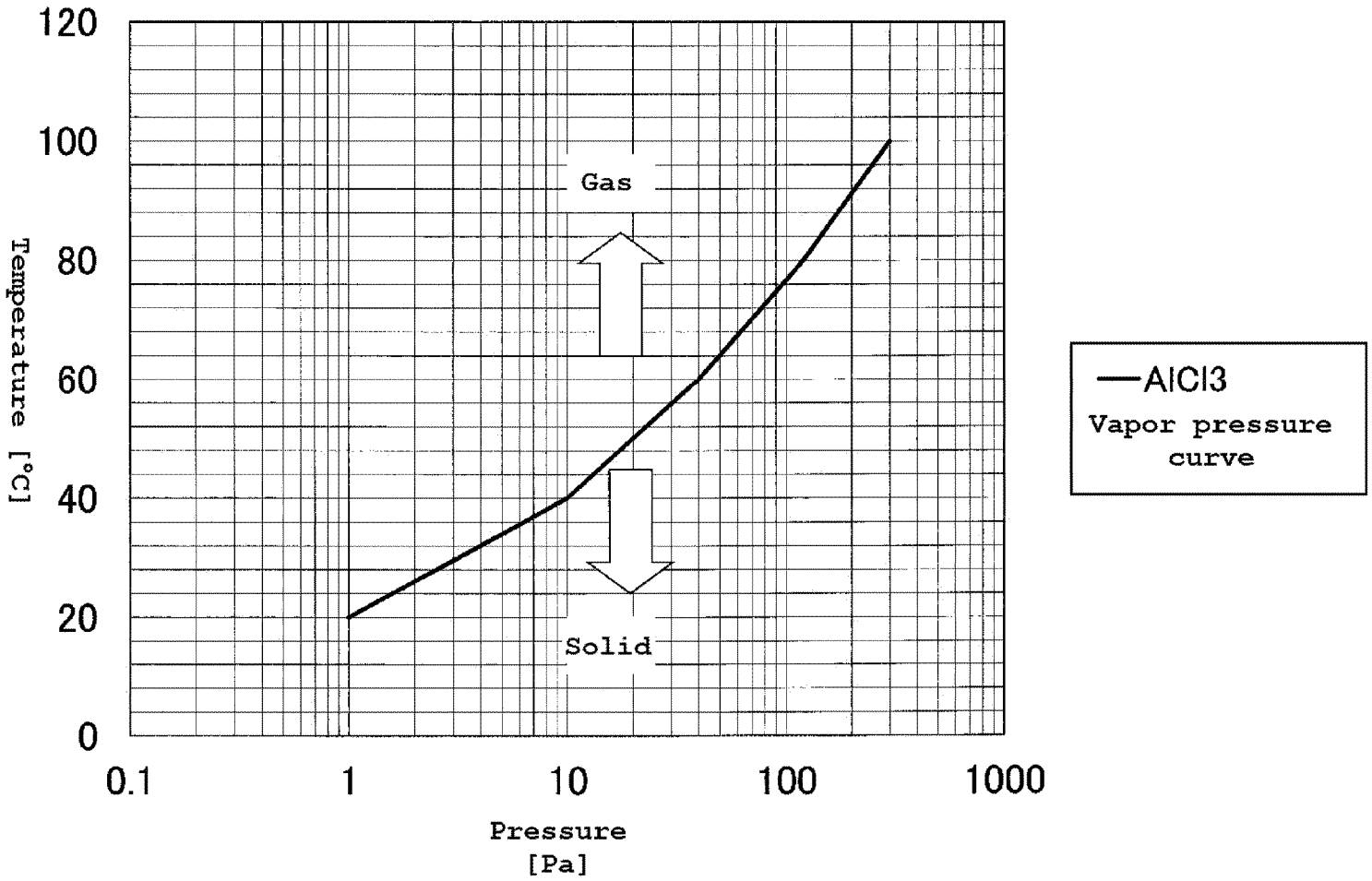
FIG. 4 is a graph showing the vapor pressure curve of $AlCl_3$ which is an example of reaction products.

FIG. 4 shows the vapor pressure curve of aluminum chloride ($AlCl_3$) which is an example of reaction products. In a region above the vapor pressure curve in the drawing, aluminum chloride becomes gas. On the other hand, in a region below the vapor pressure curve in the drawing, aluminum chloride becomes solid and is accumulated as deposit.

Figure 5:
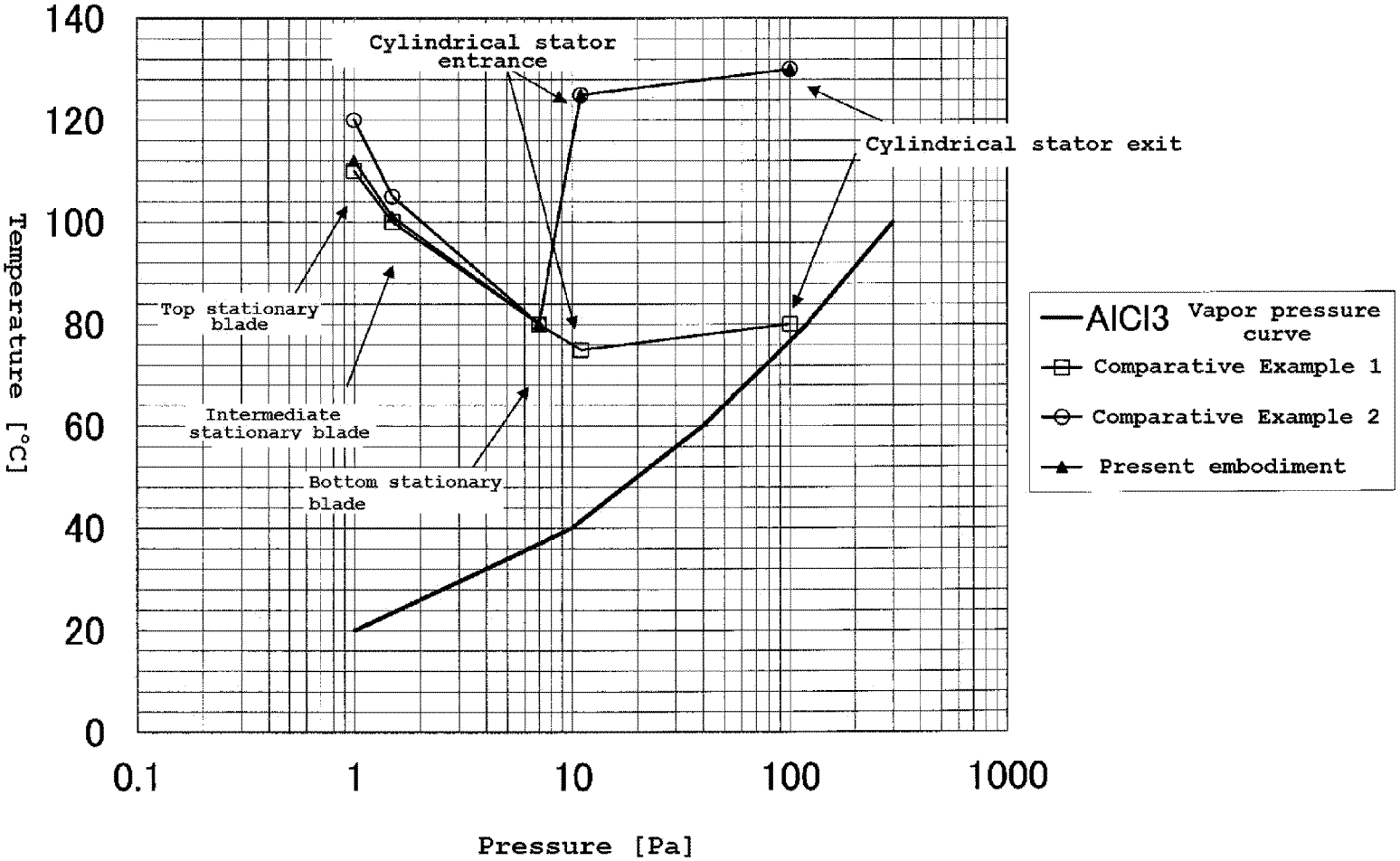
FIG. 5 is a graph showing an example of the temperature of each part in the embodiment of the present invention and Comparative Examples 1 and 2.

FIG. 5 shows, in addition to the vapor pressure curve shown in FIG. 4, an example of the temperature in each part of the stationary blades 12 and the cylindrical stator 21 in Comparative Examples 1, 2 and the present embodiment. A regulated temperature of the base 20 regulated by the heater 27 and the water-cooled pipe 50 is 75° C., a regulated temperature regulated by the stator heating member 28 is 130° C., and an allowable temperature of the rotor is 120° C. A top stationary blade indicates a stationary blade 21 located closest to a suction port of the turbo-molecular pump 1. A bottom stationary blade indicates a stationary blade 21 located closest to the exhaust port of the turbo-molecular pump 1. An intermediate stationary blade indicates a stationary blade 21 located at an intermediate position between the top stationary blade and the bottom stationary blade. A cylindrical stator entrance indicates a suction port side end of the cylindrical stator 22. A cylindrical stator exit indicates an exhaust port side end of the cylindrical stator 22.

In FIG. 5, the temperature with respect to the pressure in the cylindrical stator exit is close to the vapor pressure curve in Comparative Example 1. That is, aluminum chloride is likely to be accumulated on the exhaust port side end of the cylindrical stator 22 of the turbo-molecular pump 1A of Comparative Example 1. In view of this, as in Comparative Example 2, the cylindrical stator 22 may be thermally isolated and, in addition, the stator heating member 28 may be provided to increase the temperature of the cylindrical stator 22 so that aluminum chloride is not likely to be accumulated.

However, such a configuration causes the following problem. As shown in FIG. 3A, the pump rotor 10 has the highest temperature in Comparative Example 1. Thus, the outer surfaces S1 to S7 of the cylindrical stator 22, the rotor cylindrical section 13, the rotor blades 12, the stationary blades 21, and the base 20 are preferably black Ni plated to facilitate transfer of the heat H1, H4, H5, and H6 by radiation of the pump rotor 10.

However, as shown in FIG. 3B, the cylindrical stator 22 may have a higher temperature than the pump rotor 10 in Comparative Example 2. In this case, the cylindrical stator 22 serves as a heat source, which facilitates transfer of the heat H4 to H9 by radiation to the outer surfaces S4 to S7 of the peripheral members. Thus, the temperature of the pump rotor 10 disadvantageously exceeds 120° C. as the allowable temperature. Further, transfer of the heat H3 by conduction inside the pump rotor 10 caused by the radiant heat H4 increases the heat H1 by radiation from the rotor blades 12 to the stationary blades 21. Accordingly, the amount of the heat H1 may exceed an allowable amount of heat that can be radiated from the rotor blades 12 to the stationary blades 21.

In view of the above, in the present embodiment, as shown in FIG. 3C, the emissivity of each of the outer surfaces S3 to S7 is reduced to suppress the heat H4 to H9 by radiation from the cylindrical stator 22 to the peripheral members and, on the other hand, the emissivity of each of the outer surfaces S1, S2 is remained high to increase the amount of the heat H1 transferred by radiation from the rotor blades 12 to the stationary blades 21. As a result, it is possible to suppress temperature rise of the pump rotor 10 and prevent accumulation of reaction products.

The following modifications (A) to (D) fall within the scope of the present invention.

(A) The stator heating member 28 described above may be a stator temperature regulation member. Specifically, the block 281 is provided with not only the heater 280, but also a water-cooled pipe or an oil-cooled pipe. This configuration further facilitates temperature regulation for the cylindrical stator 22.

(B) Although no surface treatment is applied to the outer surface of the cylindrical stator 22 (in addition, the outer surfaces of the base 20, the rotor blades 12, and the stationary blades 21, the outer surfaces facing the cylindrical stator 22) in the above, Ni plating may be applied thereto. Since the emissivity of Ni is approximately 0.2 and thus relatively low, heat transfer by radiation from the cylindrical stator 22 toward the surroundings thereof is suppressed. Further, applying Ni plating to the outer surface of the cylindrical stator 22 provides corrosion resistance, which improves durability against corrosion caused by process gas.

(C) In the above, Ni plating is applied to the outer surface of the rotor cylindrical section 13, the outer surface facing the cylindrical stator 22. However, when the base material of the rotor cylindrical section 13 is an aluminum alloy, no surface treatment may be applied thereto. In this case, the emissivity of the outer surface of the rotor cylindrical section 13 is 0.1 or less and thus relatively low. Therefore, the outer surface of the rotor cylindrical section 13 is less likely to receive heat by radiation from the cylindrical stator 22.

(D) Although, in the above, anodizing is applied to the outer surfaces of the stationary blades 21, the outer surfaces facing the rotor blades 12, black Ni plating may be applied thereto instead of the anodizing. The black Ni plating enables the outer surfaces to have a high emissivity and excellent corrosion resistance. Further, although, in the above, black Ni plating is applied to the outer surfaces of the rotor blades 12, the outer surfaces facing the stationary blades 21, anodizing may be applied thereto instead of the black Ni plating.

Ni plating may be applied to the outer surface S5 (refer to FIG. 3C) of the rotor blade 12S located on the lowest end in the rotor blades 12 (the bottom rotor blade 12), the outer surface S5 facing the cylindrical stator 22.

Ni plating may be applied to the outer surface S6 (refer to FIG. 3C) of the stationary blade 21S located on the lowest end in the stationary blades 21 (the bottom stationary blade 21), the outer surface S6 facing the cylindrical stator 22.

The present invention is not limited to the above contents. Other modes conceivable within the technical idea of the present invention also fall within the scope of the present invention.

What is claimed is:

1. A turbo-molecular pump comprising:

a pump rotor including rotor blades and a rotor cylindrical section;

stationary blades facing the rotor blades;

a cylindrical stator facing the rotor cylindrical section, the cylindrical stator and the rotor cylindrical section together constituting a screw groove pump member;

a base housing the cylindrical stator; and a heating member for heating the cylindrical stator, wherein an emissivity of an outer surface of the cylindrical stator and an emissivity of an outer surface of the rotor cylindrical section which is a member facing the cylindrical stator, where the outer surface of the rotor cylindrical section faces the cylindrical stator, are low emissivity enough to suppress heat transfer by radiation from the cylindrical stator to the rotor cylindrical section and enough to suppress accumulation of reaction products on the cylindrical stator, and are lower emissivity than an emissivity of an outer surface of the rotor blades and an emissivity of an outer surface of the stationary blades, where the outer surface of the stationary blades face the rotor blades, such that the rate of heat transfer by radiation from the cylindrical stator to the rotor cylindrical section is lower than the rate of heat transfer by radiation from the rotor blades to the stationary blades.

2. The turbo-molecular pump according to claim 1, wherein the emissivity of the outer surface of the cylindrical stator and an emissivity of an outer surface of the base, the rotor blades, and the stationary blades which are members facing the cylindrical stator are low emissivity enough to suppress heat transfer by radiation from the cylindrical stator to the base, the rotor blades, and the stationary blades.

3. The turbo-molecular pump according to claim 1, wherein a temperature of the cylindrical stator is higher than a temperature of the pump rotor when the cylindrical stator is heated by the heating member.

4. The turbo-molecular pump according to claim 1, wherein the emissivity of the outer surface of the cylindrical stator and the emissivity of the outer surface of the member facing the cylindrical stator, where the outer surface of the member facing the cylindrical stator faces the cylindrical stator, are 0.3 or less.

5. The turbo-molecular pump according to claim 1, wherein an emissivity of outer surfaces of the rotor blades, where the outer surfaces of the rotor blades face the stationary blades, and an emissivity of outer surfaces of the stationary blades, where the outer surfaces of the stationary blades face the rotor blades, are 0.5 or more.

6. The turbo-molecular pump according to claim 1, wherein the outer surface of the cylindrical stator and the outer surface of the member facing the cylindrical stator, where the outer surface of the member facing the cylindrical stator faces the cylindrical stator, are Ni plated or aluminum alloys without surface treatment.

7. The turbo-molecular pump according to claim 1, wherein outer surfaces of the rotor blades, where the outer surfaces of the rotor blades face the stationary blades, and outer surfaces of the stationary blades, where the outer surfaces of the stationary blades face the rotor blades, are black Ni plated or anodized.

8. The turbo-molecular pump according to claim 1, further comprising a heat conduction suppressing member, wherein the cylindrical stator is attached to the base with the heat conduction suppressing member interposed therebetween.

* * * * *